US005378172A

United States Patent [19]

Roberts

[11] Patent Number: 5,378,172

[45] Date of Patent: Jan. 3, 1995

[54] LOW PROFILE SHIELDED JACK

[75] Inventor: James T. Roberts, Oak Park, Ill.

[73] Assignee: Molex Incorporated, Lisle, Ill.

[21] Appl. No.: 209,184

[22] Filed: Mar. 10, 1994

[51] Int. Cl.[5] ..... H01R 13/648

[52] U.S. Cl. ..... 439/607; 439/676

[58] Field of Search ..... 439/607, 609, 610, 350, 439/351, 101, 108, 676

[56] References Cited

U.S. PATENT DOCUMENTS

| | | | |
|---|---|---|---|
| 4,838,811 | 6/1989 | Nakamura et al. | 439/607 |
| 4,842,554 | 6/1989 | Cosmos et al. | 439/609 |
| 4,878,858 | 11/1989 | Dechelette | 439/607 |
| 5,083,945 | 1/1992 | Miskin et al. | 439/607 |
| 5,087,210 | 2/1992 | Myers et al. | 439/607 X |
| 5,195,911 | 3/1993 | Murphy | 439/607 |

*Primary Examiner*—Khiem Nguyen
*Attorney, Agent, or Firm*—Stephen Z. Weiss

[57] ABSTRACT

A low profile shielded jack is provided for mounting to a circuit board and for receiving a mating plug. The jack includes a substantially rectangular dielectric housing and a one-piece, substantially rectangular shield substantially surrounding the housing. Recesses are provided in a bottom board mounting wall of the housing at the juncture of the bottom wall with front or side walls of the housing. Supporting tabs at bottom edges of the shield extend into the recesses. The depths of the recesses are at least equal to the thicknesses of the supporting tabs so that the tabs do not project downwardly beyond the bottom board mounting wall of the housing.

4 Claims, 3 Drawing Sheets

LOW PROFILE SHIELDED JACK

FIELD OF THE INVENTION

This invention generally relates to the art of electrical connectors and, particularly, to a shielded jack for mounting to a circuit board, the jack having a low profile and providing protection against electromagnetic interference, radio frequency interference, and the like.

BACKGROUND OF THE INVENTION

Jacks define female electrical connectors having a non-conductive housing and electrical conductive terminals therein. The jack typically is mounted to a circuit board, panel or the like, with the terminals in the jack being electrically connected to conductive areas on the circuit board or panel. The jack is mateable with a male plug connector which also has a nonconductive housing and a corresponding number of electrically conductive terminals. The plug frequently will be mounted to a cable having a plurality of electrically conductive leads which are respectively connected to the terminals in the plug. The cable leading to the plug may define a round cable or a flat flexible cable depending upon the particular application.

The combination of jacks and mateable plugs are used in many electrical devices, with broad applications being found in computers and telecommunications equipment. In most such applications it is necessary to shield signal-carrying circuits to avoid generating electromagnetic interference (EMI), and/or to avoid being impacted by ambient EMI. In particular, the signal carrying cables leading to the above described plug typically will include an electrically conductive shield, such as a braid or foil, extending around the signal carrying conductors of the cable. The plug to which the cable is connected also may include an electrically conductive shield extending thereabout and in electrical contact with the shield of the cable.

The jack will include its own shield which will be grounded to the board on which the jack is mounted. The typical shield for the prior art jack is mounted to the exterior of the jack housing, and has solder tails or other such board contact means unitary therewith and disposed to be electrically connected to grounds on the board. The shield of the prior art jack includes contact means extending into the plug-receiving cavity of the jack. The contact means of the shield for the prior art jack are disposed to electrically contact the shield of the above-described plug.

Many jacks have standard configurations and dimensions within various industries. One type of shielded jack is "box" or rectangularly shaped and includes a rectangularly shaped dielectric housing having a front face, a bottom board mounting wall, and a top, a rear and a pair of side walls substantially surrounding the plug-receiving cavity which extends rearwardly from the front face for receiving the mating plug. Although shields have been fabricated by a plurality of parts, it has become widely accepted to provide the shield as a one-piece, substantially rectangular component stamped and formed of sheet metal material and having front, top, rear and side wall portions substantially surrounding and shielding the front face and the top, rear and side walls of the dielectric housing. Examples of these types of "box" or rectangularly shaped jacks are shown in U.S. Pat. Nos. 4,679,879; 4,878,858; 5,083,945 and 5,195,911, all of which are assigned to the assignee of the present invention.

One of the problems that has affected the design of such shielded jacks for many years is the miniaturization that continue to be demanded in the computer and telecommunications industries. Continuing miniaturization and greater circuit density demands that electrical connectors, including shielded jacks, provide a low profile on the circuit board. Even small reductions in a connector's or jack's profile are greeted with significant commercial success. Particularly desirable are connectors or jacks which can provide a lower profile while still being mateable with an accepted and standardized plug connector.

One area in which the height profile of a jack is affected involves mounting the rectangular shield about the rectangular dielectric housing. Surrounding the front, rear, top and side walls of the housing with a thickness of the shield practically has become a given parameter. However, attempts have been made to eliminate the thickness (i.e. height) of the shield at the bottom board mounting wall of the jack housing. Portions of the shield usually must be folded under the housing to maintain structural stability for the shield. For instance, such stability is necessary to keep the shield side walls from opening up from the bottom. However, the existence of flaps or tabs beneath the housing increases the height profile of the jack. Attempts have been made to insert the flaps or tabs into slots in the housing above the bottom board mounting wall thereof, but these attempts have proven difficult to achieve during assembly, without involving expensive assembly operations.

This invention is directed to solving those problems by providing improvements wherein the shield is mounted about the jack housing in a very simple and efficient manner without any portions of the shield projecting below the bottom mounting wall of the jack housing.

SUMMARY OF THE INVENTION

An object, therefore, of the invention is to provide a new and improved low profile shielded jack for mounting to a circuit board and for receiving a mating plug.

In the exemplary embodiment of the invention, the jack includes a substantially rectangular dielectric housing having a front face, a bottom board mounting wall, and a top, rear and a pair of side walls substantially surrounding a plug-receiving cavity. The cavity extends rearwardly from the front face for receiving a mating plug connector. A plurality of terminals are mounted in the housing for making electrical contact with corresponding terminals on the plug connector when inserted into the plug-receiving cavity. A one-piece, substantially rectangular shield is provided of stamped and formed conductive material, such as sheet metal. The shield has front, top, rear and side wall portions substantially surrounding and shielding the front face and the top, rear and side walls, respectively, of the dielectric housing.

The invention contemplates that at least two recesses be provided in the bottom board mounting wall of the housing at the juncture thereof with the front face of the housing. Supporting tabs at a bottom edge of the front wall of the shield extends rearwardly into the recesses. The depth of the recesses are at least equal to the thickness of the supporting tabs so that the tabs do not project downwardly beyond the bottom board mounting wall of the housing.

As disclosed herein, the bottom of the front face and the front of the bottom board mounting wall of the housing are open to define an opening which communicates with the cavity for accommodating a depending latch arm of the plug connector. One of the recesses is provided in the bottom board mounting wall of the housing at each opposite side of the opening, and a pair of the supporting tabs on the shield extend into the recesses.

The invention also contemplates the provision of a second pair of recesses in the bottom board mounting wall of the housing at the juncture thereof with the side walls of the housing. A second pair of supporting tabs are provided at bottom edges of the side walls of the shield and extend inwardly into the second pair of recesses. Again, the depths of the second pair of recesses are at least equal to the thicknesses of the supporting tabs so that the pair of supporting tabs do not project downwardly beyond the bottom board mounting wall of the housing. As disclosed herein, the pair of recesses are located at the juncture of the bottom and side walls of the housing with the rear wall of the housing.

As will be seen in the detailed description of the invention, hereinafter, the above-described structure of the one-piece shield provides for a very simple and efficient mounting of the entire shield about the dielectric housing of the jack.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
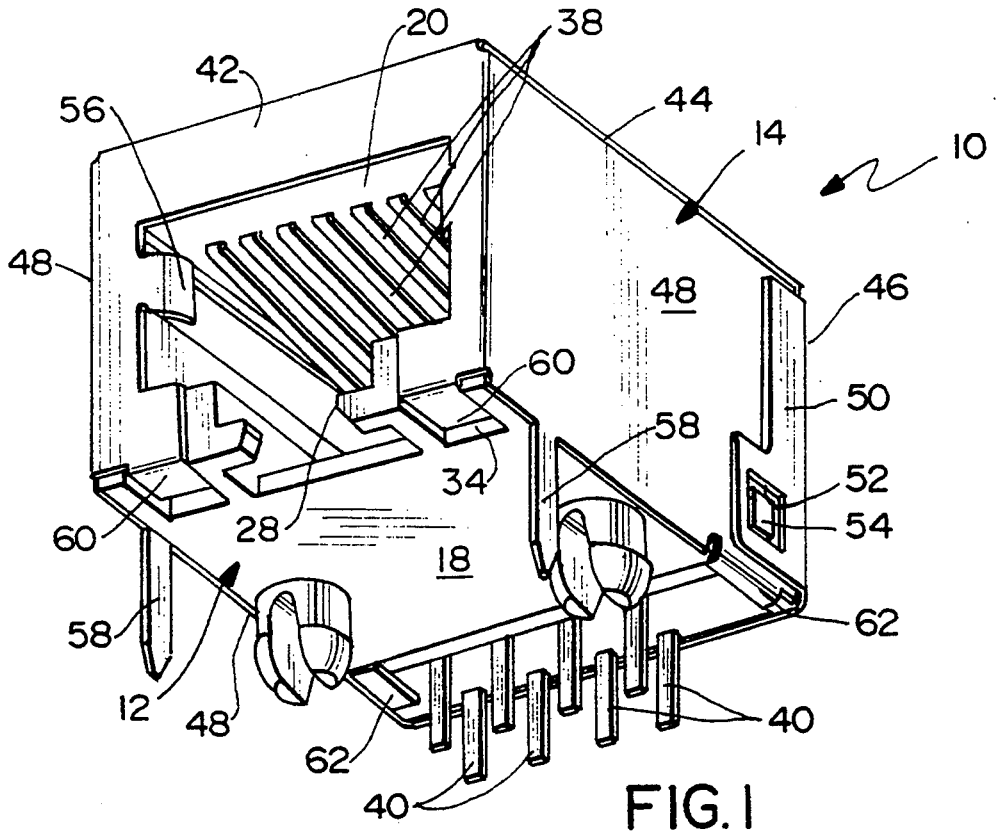
FIG. 1 is a bottom perspective view of a low profile shielded jack embodying the concepts of the invention.

Referring to the drawings in greater detail, and first to FIG. 1, the invention is embodied in a low profile shielded jack, generally designated 10, for mounting to a circuit board (not shown) and for receiving a mating plug of standardized configuration. The jack includes a substantially rectangular dielectric housing, generally designated 12, substantially surrounded by a one-piece substantially rectangular shield, generally designated 14. The housing is unitarily molded of dielectric material such as plastic or the like. The one-piece shield is stamped and formed of conductive sheet metal material.

Figure 2:
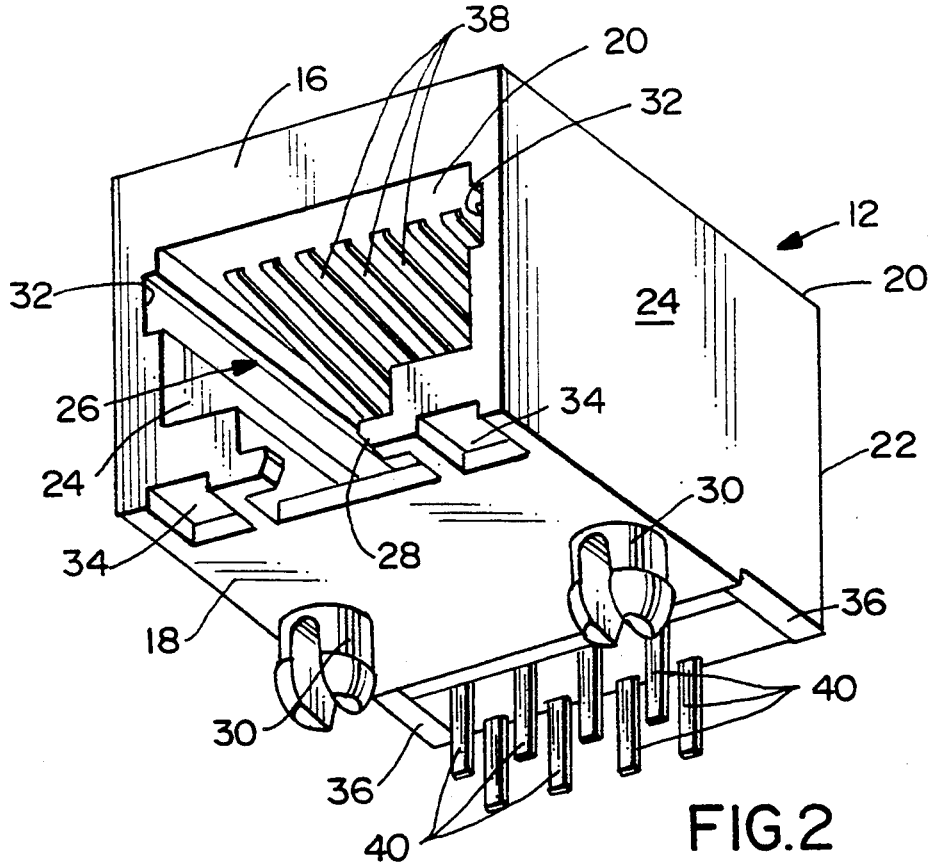
FIG. 2 a bottom perspective view of the dielectric housing of the jack.

Referring to FIG. 2 in conjunction with FIG. 1, dielectric housing 12 includes a front face 16, a bottom board mounting wall 18, a top wall 20, a rear wall 22 and a pair of side walls 24 substantially surrounding a plug-receiving cavity indicated generally at 26. The plug-receiving cavity extends rearwardly from front face 16 for receiving a mating plug connector of standardized configuration. To that end, as is known in the art, the plug connector includes a depending cantilevered latch arm projecting outwardly from one side (e.g. the bottom) thereof. It can be seen that the bottom of front face 16 and the front of bottom board mounting wall 18 is open to define an opening 28 which communicates with cavity 26. This opening accommodates the depending latch arm of the plug connector to reduce the height profile of the housing and, therefore, the overall jack.

Housing 12 further includes a pair of bifurcated mounting posts 30 for insertion into complementary mounting holes in the circuit board. For purposes to be described hereinafter, an interior slot 32 is provided inside each side wall 24 of the housing. Lastly, the invention contemplates that the bottom board mounting wall 18 of housing 12 include a pair of front recesses 34 and a pair of rear recesses 36. As clearly seen in FIG. 2, front recesses 34 are provided in bottom board mounting wall 18 at the juncture thereof with front face 16 of the housing. Rear recesses 36 are provided in the bottom board mounting wall at the juncture thereof with side walls 24 and rear wall 22 of the housing.

Generally, a plurality of terminals are mounted in housing 12 for making electrical contact with corresponding terminals on the mating plug connector when inserted into plug-receiving cavity 26, and for electrically coupling the plug terminals to circuit traces on the circuit board. More particularly, as is known in the art, the terminals include contact spring arms 38 extending inwardly and rearwardly of plug-receiving cavity 26 in a cantilevered fashion. The contact spring arms make electrical contact with the corresponding terminals on the plug connector when the plug connector is inserted into the cavity. The terminals further include tail portions 40 projecting downwardly beyond bottom board mounting wall 18 of the housing for insertion into appropriate holes in the circuit board and for solder connection to appropriate circuit traces on the board and/or in the holes.

Figure 3:
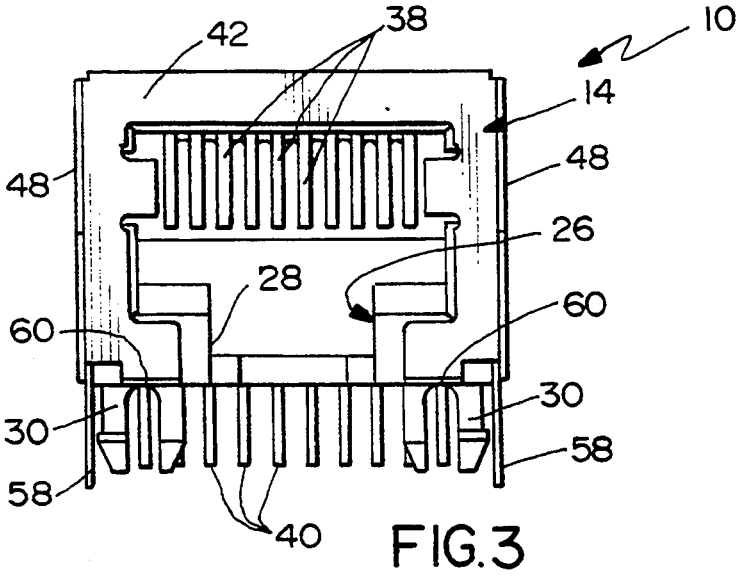
FIG. 3 is a front elevational view of the jack.
Figure 4:
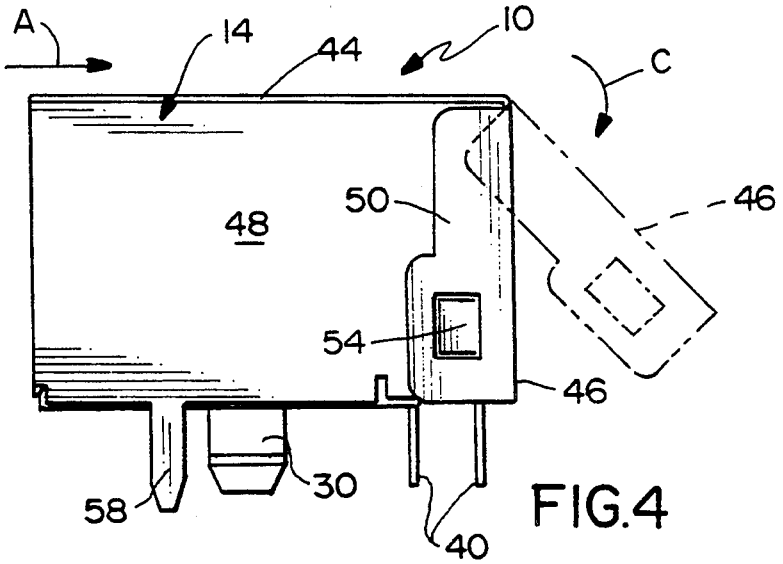
FIG. 4 is a side elevational view of the jack, with the rear wall of the shield shown in phantom prior to final assembly.
Figure 5:
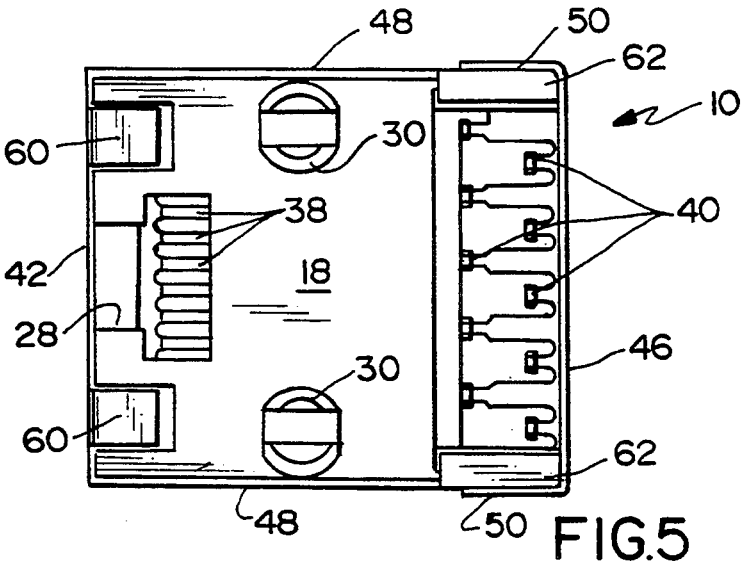
FIG. 5 is a bottom plan view of the jack.

Referring to FIGS. 3–5 in conjunction with FIG. 1, one-piece shield 14 includes a front wall portion 42, a top wall portion 44, a rear wall portion 46 and a pair of side wall portions 48 substantially surrounding and shielding front face 16, top wall 20, rear wall 22 and side walls 24, respectively, of dielectric housing 12. Rear wall portion 46 includes a pair of side flanges 50 which are bent forwardly and include holes 52 for snappingly engaging over a pair of latch bosses 54 projecting outwardly of side wall portions 48 during assembly, as described hereinafter. Front wall portion 42 has a pair of rearwardly bent contact tabs 56 extending into plug-receiving cavity 26 to electrically contact appropriate shield means on the mating plug connector when inserted into the cavity. Each side wall portion 48 of the shield includes a solder tail 58 extending downwardly therefrom for insertion into appropriate holes in the circuit board and for solder connection to appropriate ground traces on the board and/or in the holes.

From the foregoing, it can be seen that the front, top, rear and side wall portions of shield 14 substantially surround jack housing 12 to avoid generating electromagnetic interference and/or to avoid being subjected to ambient electromagnetic interference. In addition, contact tabs 56 will engage the shield of the mating plug connector and, through solder tails 58, ground the plug connector to the ground traces on the circuit board.

Generally, the invention contemplates the provision of one or more recesses in bottom board mounting wall 18 of dielectric housing 12 for receiving supporting tabs at the bottom edges of shield 14 to provide structural stability for the shield while providing a low profile for the overall jack. More particularly, as stated above in describing dielectric housing 12, a pair of recesses 34 are provided in bottom board mounting wall 18 at the juncture thereof with front face 16 of the housing. The recesses are provided at opposite sides of opening 28 which, itself, facilitates the low profile of the jack by accommodating the latch arm of the mating connector plug. Now referring to FIGS. 1 and 5, it can be seen that a pair of supporting tabs 60 are formed at the bottom edge of front wall portion 42 of shield 14. The supporting tabs are bent rearwardly and extend into recesses 34. The depths of recesses 34 are at least equal to the thicknesses of supporting tabs 60 so that the tabs do not project downwardly beyond bottom board mounting wall 18 of the housing. This can be seen in FIG. 3. Therefore, supporting tabs 60 provide structural stability for the front of the shield without in any way adding to the height profile of the jack.

In addition, as stated above in describing dielectric housing 12, a pair of recesses 36 are provided in bottom board mounting wall 18 at the juncture thereof with side walls 24 and rear wall 22 of the housing. Again, as best seen in FIGS. 1 and 5, a pair of supporting tabs 62 are provided at the bottom edges of side wall portions 48 of shield 14 for extending inwardly into recesses 36 to provide structural stability for the rear of the shield. Again, the depths of recesses 36 are at least equal to the thicknesses of supporting tabs 62 so that the tabs do not project downwardly beyond bottom board mounting wall 18 of the housing. This again can be seen in FIG. 3.

Figure 6:
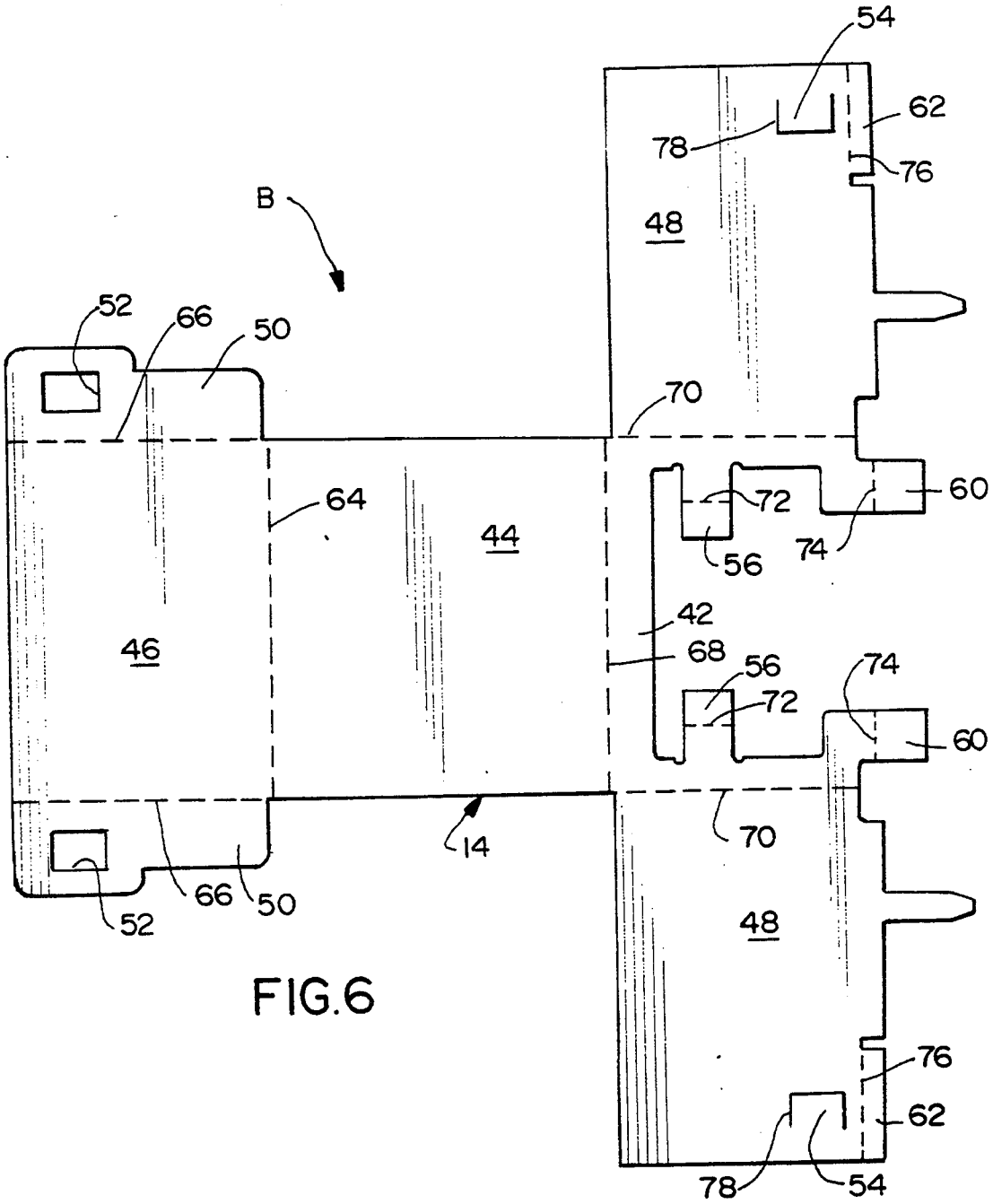
FIG. 6 is a plan view of a stamped sheet metal blank prior to being formed into the one-piece shield of the jack.

FIG. 6 shows a stamped blank "B" of sheet metal material from which one-piece shield 14 is formed. Like numerals are applied in FIG. 6 corresponding to like portions of the one-piece shield described above. Therefore, it can be understood that rear wall portion 46 is bent or formed relative to top wall portion 44 along a bend line 64. Side flanges 50 are bent inwardly relative to rear wall portion 46 along bend lines 66. Top wall portion 44 is bent downwardly relative to front wall portion 42 along bend line 68, and side wall portions 48 are bent rearwardly of the front wall portion along bend lines 70. Contact tabs 56 are bent rearwardly along bend lines 72. Front supporting tabs 60 are bent rearwardly along bend lines 74, and rear supporting tabs 62 are bent inwardly along bend lines 76. Lastly, latch bosses 54 actually are formed by U-shaped cuts 78 in side wall portions 48, to provide a pair of flaps which are bent outwardly of the planes of side wall portions 48 to define the latch bosses which snap into holes 52 in side flanges 50 of rear wall portion 46.

In assembly, the entire one-piece shield is formed by bending the respective components thereof about the bend lines described above in reference to stamped blank "B" in FIG. 6, except for rear wall portion 46. The rear wall portion will remain coplanar with top wall portion 44 during initial assembly. The partially formed shield then is assembled over dielectric housing 12 in the direction of arrow "A" in FIG. 4. Inwardly bent supporting tabs 62 will "expand" slightly under the inherent resiliency of the sheet metal material and slide along the outside edges of bottom board mounting wall 18 until supporting tabs 62 snap into recesses 36. During the final assembly movement of the shield in the direction of arrow "A" onto the front of the dielectric housing, front supporting tabs 60 simply will move directly into recesses 34 in the bottom board mounting wall of the housing. Similarly, contact tabs 56 will slide directly into slots 32 on the inside of the housing side walls. Once moved to its fully assembled location with front wall portion 42 of the shield abutting against front face 16 of the housing, rear wall portion 46 of the housing simply is bent downwardly in the direction of arrow "C" until side flanges 50 embrace side walls 48 of the shield and latch bosses 54 snap into holes 52 in the side flanges. It is readily apparent that the assembly operation of shield 14 onto housing 12 is extremely simple, involving two simple steps, while yet providing tremendous locations for supporting tabs 60 and 62 without in any way increasing the height profile of the jack.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a low profile shielded jack for mounting to a circuit board and for receiving a mating plug, the jack including a substantially rectangular dielectric housing having a front face, a bottom board mounting wall, and a top, rear and a pair of side walls substantially surrounding a plug-receiving cavity extending rearwardly from the front face for receiving a mating plug connector, where both a bottom portion of said front face and a front portion of said bottom board mounting wall being open to define an opening communicating with the cavity for accommodating a depending latch arm of a plug connector, a plurality of terminals mounted in the housing for making electrical contact with corresponding terminals on the plug connector when inserted into the plug-receiving cavity, a one-piece, substantially rectangular shield stamped and formed of conductive material and having front, top, rear and side wall portions substantially surrounding and shielding the front face and the top, rear and side walls, respectively, of the dielectric housing, wherein the improvement comprises at least two recesses in the bottom board mounting wall of the housing at the juncture thereof with the front face of the housing, one of said recesses provided at opposite sides of said opening, supporting tabs at a bottom edge of the front wall portion of the shield and extending rearwardly into said recesses, and the depth of said recess being at least equal to the thickness of said supporting tab so that the tab does not project downwardly beyond the bottom board mounting wall of the housing.

2. In a low profile shielded jack as set forth in claim 1, wherein the depths of said pair of recesses being at least equal to the thicknesses of said pair of supporting tabs so that the pair of supporting tabs do not project downwardly beyond the bottom board mounting wall of the housing.

3. In a low profile shielded jack as set forth in claim 2, wherein a second pair of recesses are located in the bottom board mounting wall at the juncture of the bottom and side walls of the housing with the rear wall of the housing and including a complementary second pair of rear supporting tabs at the rear bottom edge of the side wall portion of the shield for extending into the second recesses.

4. In a low profile shielded jack as set forth in claim 3 wherein the depths of said second pair of recesses being at least equal to the thicknesses of said second pair of supporting tabs so that the second pair of supporting tabs do not project downwardly beyond the bottom board mounting wall of the housing.

* * * * *